US012104467B2

(12) United States Patent
Moreno et al.

(10) Patent No.: US 12,104,467 B2
(45) Date of Patent: Oct. 1, 2024

(54) SLIP PACKAGE WITH IMPROVED INITIAL SETTING

(71) Applicant: Schlumberger Technology Corporation, Sugar Land, TX (US)

(72) Inventors: Carlos Moreno, Rosharon, TX (US); Kameron Lee Klauber, Vista, CA (US); James Rounding, Rosharon, TX (US); Martin Hernandez, Pearland, TX (US); Zachary Gortowski, Manvel, TX (US); Amanda Halbert, Rosharon, TX (US); Michael Underbrink, Eureka, MO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/251,291

(22) PCT Filed: Oct. 25, 2021

(86) PCT No.: PCT/US2021/056492
§ 371 (c)(1),
(2) Date: May 1, 2023

(87) PCT Pub. No.: WO2022/098533
PCT Pub. Date: May 12, 2022

(65) Prior Publication Data

US 2023/0407729 A1 Dec. 21, 2023

Related U.S. Application Data

(60) Provisional application No. 63/109,209, filed on Nov. 3, 2020.

(51) Int. Cl.
*E21B 43/10* (2006.01)

(52) U.S. Cl.
CPC ..... *E21B 43/103* (2013.01)

(58) Field of Classification Search
CPC ..... E21B 23/01; E21B 33/129
See application file for complete search history.

(56) References Cited

U.S. PATENT DOCUMENTS 4,059,150 A 11/1977 Manderscheid
4,060,131 A 11/1977 Kenneday et al.
(Continued)

FOREIGN PATENT DOCUMENTS

CN 203161142 U 8/2013
JP 20040106049 A 4/2004
(Continued)

OTHER PUBLICATIONS

International Preliminary Report on Patentability issued in PCT Application PCT/US2021/015367 dated Aug. 11, 2022, 8 pages.
(Continued)

*Primary Examiner* — David Carroll
(74) *Attorney, Agent, or Firm* — Jeffrey D. Frantz

(57) ABSTRACT

A system for use in a well includes a liner hanger including a mandrel, a cone mounted about the mandrel, the cone having tapered slips, a plurality of tapered slips slidably received in the tapered slots, each tapered slip of the plurality of tapered slips comprising a plurality of teeth, wherein each tapered slip of the plurality of tapered slips and the corresponding tapered slot includes a setting ramp, and a loading ramp separate from the setting ramp, and an actuator mounted about the mandrel to selectively shift the plurality of tapered slips between a radially contracted position and a radially expanded, set position.

15 Claims, 6 Drawing Sheets

(56) References Cited

U.S. PATENT DOCUMENTS

| | | | | |
|---|---|---|---|---|
| 4,096,913 | A | 6/1978 | Kenneday et al. | |
| 4,662,453 | A | 5/1987 | Brisco | |
| 4,688,642 | A | 8/1987 | Baker | |
| 4,711,326 | A | 12/1987 | Baugh et al. | |
| 4,732,212 | A * | 3/1988 | Fraser, III | E21B 23/01 166/216 |
| 4,750,563 | A | 6/1988 | Baugh | |
| 4,762,177 | A | 8/1988 | Smith, Jr. | |
| 4,834,185 | A | 5/1989 | Braddick | |
| 5,086,845 | A | 2/1992 | Baugh | |
| 5,174,397 | A | 12/1992 | Currington | |
| 5,311,941 | A | 5/1994 | Baugh | |
| 5,318,131 | A | 6/1994 | Baker | |
| 5,487,427 | A | 1/1996 | Curington | |
| 6,877,567 | B2 | 4/2005 | Hirth | |
| 7,431,096 | B2 | 10/2008 | Fay | |
| 7,614,449 | B2 | 11/2009 | Anderson | |
| 7,766,088 | B2 | 8/2010 | Saucier et al. | |
| 8,047,279 | B2 | 11/2011 | Barlow et al. | |
| RE43,198 | E | 2/2012 | Anderson | |
| 8,584,765 | B2 | 11/2013 | Slup | |
| 8,978,772 | B2 | 3/2015 | Yates et al. | |
| 9,556,714 | B2 | 1/2017 | Hughes et al. | |
| 9,752,418 | B2 | 9/2017 | Meador et al. | |
| 9,759,027 | B2 | 9/2017 | Meador et al. | |
| 9,803,435 | B2 | 10/2017 | Louviere et al. | |
| 9,816,357 | B2 | 11/2017 | Abraham | |
| 9,890,614 | B2 | 2/2018 | MacLeod et al. | |
| 10,077,624 | B2 | 9/2018 | Doane | |
| 10,145,202 | B2 | 12/2018 | Anderson et al. | |
| 10,267,121 | B2 | 4/2019 | Macleod et al. | |
| 10,280,715 | B2 | 5/2019 | MacLeod et al. | |
| 10,408,003 | B2 | 9/2019 | Moyes | |
| 10,513,898 | B2 | 12/2019 | Allamon et al. | |
| 10,633,942 | B2 | 4/2020 | Dockweiler | |
| 11,661,814 | B1 * | 5/2023 | Saraya | E21B 23/01 166/387 |
| 2006/0102361 | A1 * | 5/2006 | Fay | E21B 33/124 166/134 |
| 2007/0007014 | A1 * | 1/2007 | Sessions | E21B 23/04 166/208 |
| 2012/0012306 | A1 | 1/2012 | Treadaway et al. | |
| 2012/0037381 | A1 * | 2/2012 | Giroux | E21B 23/01 166/217 |
| 2014/0020911 | A1 | 1/2014 | Martinez | |
| 2017/0268301 | A1 * | 9/2017 | Porta | E21B 33/129 |
| 2018/0023368 | A1 | 1/2018 | Anderson et al. | |
| 2018/0112480 | A1 | 4/2018 | Allamon et al. | |
| 2020/0018131 | A1 * | 1/2020 | Telfer | E21B 33/129 |
| 2023/0072517 | A1 * | 3/2023 | Moreno | E21B 33/129 |

FOREIGN PATENT DOCUMENTS

| | | | | |
|---|---|---|---|---|
| WO | 2006023952 | A1 | 3/2006 | |
| WO | 2017119868 | A1 | 7/2017 | |
| WO | WO-2018162897 | A1 * | 9/2018 | E21B 23/01 |
| WO | 2021154907 | A1 | 8/2021 | |

OTHER PUBLICATIONS

International Preliminary Report on Patentability issued in PCT Application PCT/US2021/056492 dated May 19, 2023, 9 pages.
International Search Report and Written Opinion issued in PCT Application PCT/US2021/015367, dated May 7, 2021 (11 pages).
International Search Report and Written Opinion issued in PCT Application PCT/US2021/056492, dated Feb. 14, 2022 (12 pages).

* cited by examiner

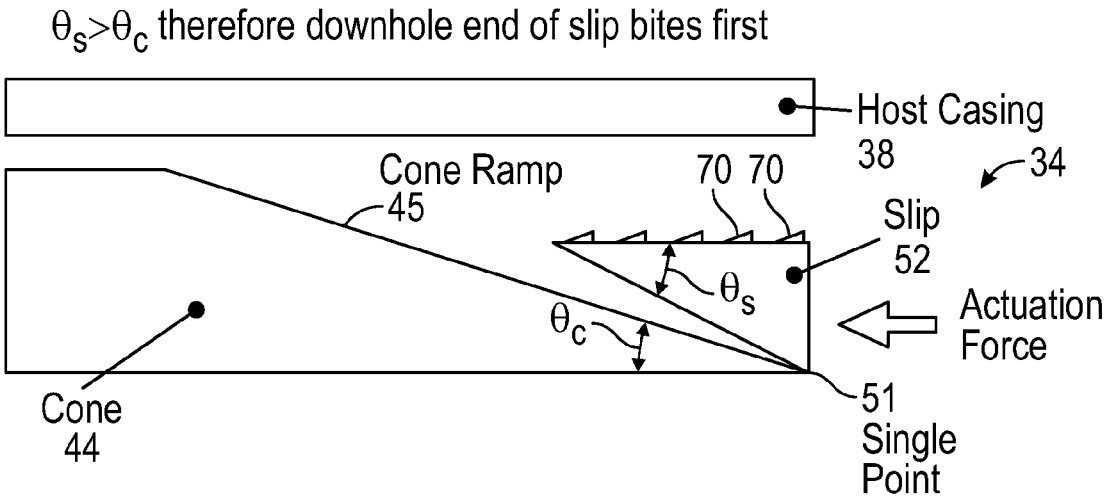
FIG. 5 (a) RIH
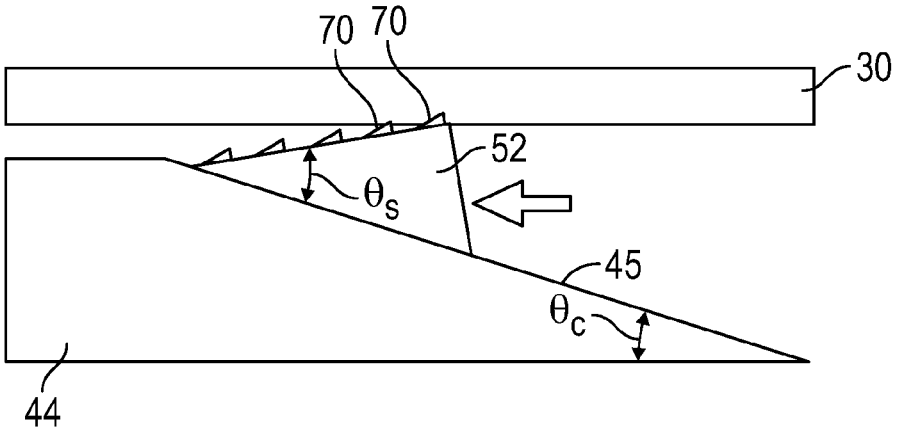
FIG. 5 (b) Initial Setting

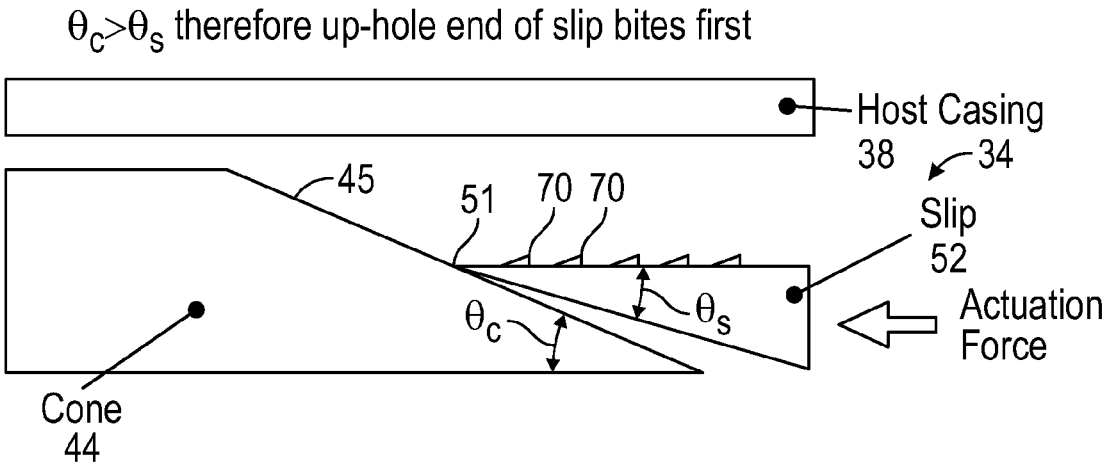
FIG. 6 (a) RIH
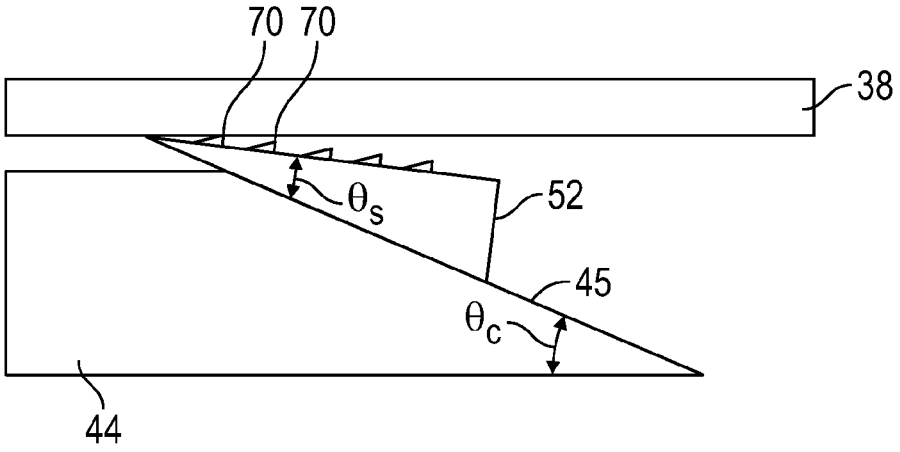
FIG. 6 (b) Initial Setting

SLIP PACKAGE WITH IMPROVED INITIAL SETTING

The present application is a national stage entry under 35 U.S.C. 371 of International Application No. PCT/US2021/056492, filed Oct. 25, 2021, which claims priority benefit of U.S. Provisional Application No. 63/109,209, filed Nov. 3, 2020, the entirety of which is incorporated by reference herein and should be considered part of this specification.

BACKGROUND

In many well applications, a wellbore is drilled and a casing string is deployed along the wellbore. A liner hanger may then be used to suspend a liner downhole within the casing string. The liner hanger may be hydraulically operated via a hydraulic cylinder to set hanger slips. Once the liner hanger is run-in-hole and positioned properly, the hanger slips are set against the surrounding casing string. The set slips are responsible for ensuring sufficient gripping of the surrounding casing string to hold the weight of the liner and to hold against mechanical and hydraulic loads applied to the system.

An important aspect of a slip package design for a liner hanger is ensuring that the slips reliably set and grip into the surrounding casing on each and every deployment. The slips are actuated hydraulically or mechanically depending on the type of hanger with relatively small loads compared to the maximum hang load rating of the slips. In the past, liner hangers have been known to "slip downhole" if they do not successfully bite into the casing during the setting process. Accordingly, there is a continued need for a slip package with improved initial setting for liner hanger applications.

SUMMARY

According to one or more embodiments of the present disclosure, a system for use in a well includes a liner hanger including a mandrel; a cone mounted about the mandrel, the cone having tapered slots; a plurality of tapered slips slidably received in the tapered slots, each tapered slip of the plurality of tapered slips comprising a plurality of teeth, wherein each tapered slip of the plurality of tapered slips and the corresponding tapered slot includes: a setting ramp; and a loading ramp separate from the setting ramp; and an actuator mounted about the mandrel to selectively shift the plurality of tapered slips between a radially contracted position and a radially expanded, set position.

According to one or more embodiments of the present disclosure, a system for use in a well includes, a liner hanger including a mandrel; a cone mounted about the mandrel, the cone having tapered slots; a plurality of tapered slips slidably received in the tapered slots, each tapered slip of the plurality of tapered slips including a plurality of teeth; and an actuator mounted about the mandrel to selectively shift the plurality of tapered slips between a radially contracted position and a radially expanded, set position, wherein the cone includes a cone ramp angle, wherein each tapered slip of the plurality of tapered slips includes a slip ramp angle, wherein the cone ramp angle is different from the slip ramp angle, and wherein, upon an actuation force by the actuator: each tapered slip of the plurality of tapered slips contacts the tapered slot of the cone in which the tapered slip is slidably received at a single point at a first end of the tapered slip; and a second end of the tapered slip is unsupported, causing the first end of the tapered slip to rise toward and bite into a host casing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIGS. 5A and 5B show examples of a biased downhole slip of a liner hanger, according to one or more embodiments of the present disclosure;

FIGS. 6A and 6B show examples of a biased uphole slip of a liner hanger, according to one or more embodiments of the present disclosure.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

One or more embodiments of the present disclosure generally relates to a system and methodology for deploying and setting a liner hanger assembly. More specifically, one or more embodiments of the present disclosure provides a liner hanger assembly including a slip package that ensures a successful initial set or "bite" into the host casing. The design of the slip package according to one or more embodiments of the present disclosure includes one or both of (1) dedicated zones for setting and loading; and (2) "biased" ramp angles of the slip and cone to concentrate the initial bite to a smaller area of the host casing.

Figure 1:
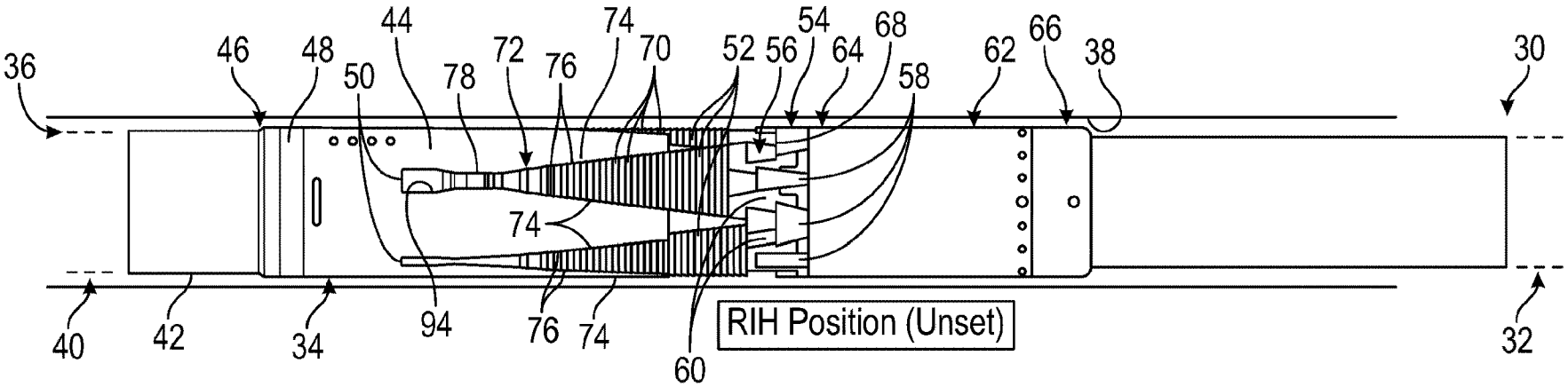
FIG. 1 shows an example of a liner hanger deployed in a borehole, e.g., a wellbore, in a run-in-hole position, according to one or more embodiments of the present disclosure.

Referring generally to FIG. 1, an embodiment of a liner hanger assembly 30 is illustrated as having a liner 32 coupled with a liner hanger 34. The liner hanger assembly 30 is deployed downhole into a borehole 36, e.g. a wellbore, which may be lined with a casing 38. In FIG. 1, the liner hanger 34 is illustrated in an unset, run-in-hole position, which allows the liner hanger assembly 30 to be deployed via a liner hanger string 40 to a desired location along the borehole 36 and casing 38.

According to an example, the liner hanger 34 comprises an inner mandrel 42 having an internal passage through which, for example, fluid and/or equipment is able to move. In this embodiment, a cone 44 is slid onto the mandrel 42 to an abutment 46. In some applications, a spacer or bearing 48 may be positioned between the abutment 46 and the cone 44. The cone 44 may be generally tubular in structure and sized to slide along the tubular exterior of the mandrel 42. Additionally, the cone 44 comprises a plurality of cone slots 50 arranged generally in an axial direction along a portion of the cone 44. The cone slots 50 are sized to receive corresponding hanger slips 52, according to one or more embodiments of the present disclosure.

As illustrated, the liner hanger 34 also comprises a retainer or retention ring 54 which engages lower ends 56 of the slips 52 so as to facilitate retention of the slips 52 when, for example, the liner hanger assembly 30 is run-in-hole. By way of example, the retention ring 54 may comprise a plurality of retention ring fingers 58. The retention fingers 58 interlock with a plurality of corresponding slip fingers 60 located at the lower ends 56 of the slips 52.

On an opposite side of the retention ring 54 from slips 52, the retention ring 54 may be engaged by a cylinder 62 or other suitable actuator component mounted about the mandrel 42. The cylinder 62 may have an engagement feature 64 which slides over and engages the retention ring 54. By way of example, the engagement feature 64 may be in the form of an expanded inner diameter section of the cylinder 62 which is sized to slide over a portion of the retention ring 54 before abutting the remaining portion of retention ring 54. Additionally, the cylinder 62 may be part of an overall actuator 66, e.g. a hydraulic actuator, a mechanical actuator, or another suitable actuator. For example, the cylinder may be a hydraulically actuated cylinder 62 or a mechanically actuated cylinder 62. The actuator 66 also may have other configurations and may use other types of engagement features 64.

When the engagement feature 64 is positioned against an abutment edge 92 of the retention ring 54, the slip fingers 60 are blocked from moving linearly/axially farther into the spaces 88 between retention ring fingers 58. By limiting this linear/axial movement of the slips 52, the slips 52 are prevented from shifting to a decoupling position while at the same time the cooperating angled surfaces 84, 86, 90 prevent sufficient radial movement of the slips to enable release the slips. Accordingly, the slips 52 are secured along the cone 44 and cannot be inadvertently released or set until cylinder 62 is actuated to force slips 52 to a set position.

Figure 2:
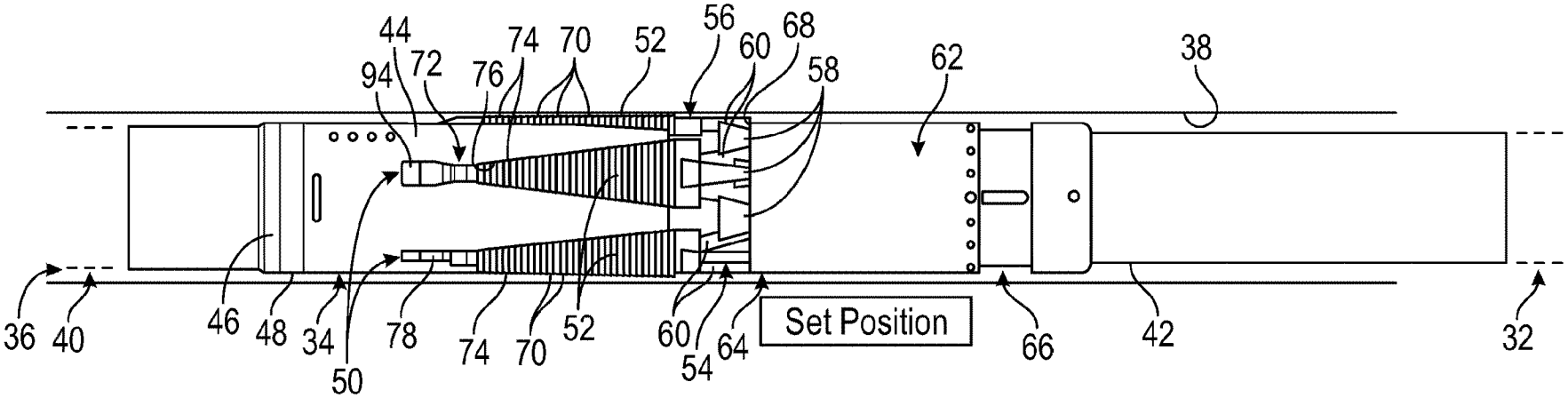
FIG. 2 shows the liner hanger shown in FIG. 1, but in a set position, according to one or more embodiments of the present disclosure.

In the illustrated example, the cylinder 62 is a hydraulic cylinder which may be hydraulically actuated in an axial direction to shift the retention ring 54 until a face 68 of cylinder 62 is moved into abutting engagement with the lower ends 56 of the slips 52. Continued linear movement of the cylinder 62 in the direction toward slips 52 causes linear/axial movement of the slips 52. The linear movement of slips 52 effectively causes an interaction with cone 44 which forces the slips 52 radially outward into a set position, as illustrated in FIG. 2. In other words, the slips 52 and liner hanger 34 are transitioned from a radially contracted, run-in-hole position to a radially expanded set position. In the set position, teeth 70 (or other types of gripping members) of the slips 52 are forced into gripping engagement with an interior surface of the surrounding casing 38.

In the example illustrated in FIGS. 1 and 2, each slip 52 is constructed as a tapered slip slidably received in the corresponding slots 50 which have corresponding tapers. For example, each slip 52 may taper along its length between an upper end 72 and lower end 56 such that upper end 72 is relatively narrow in a circumferential direction. From upper end 72, the slip 52 tapers outwardly in a circumferential direction on both circumferential sides of the slip such that the portion of the slip 52 proximate lower end 56 is wider than the relatively narrow upper end 72.

Each corresponding slot 50 also may be tapered with a corresponding taper that expands in a circumferential direction moving from an upper region of the slot 50 to a lower region of the slot 50. Additionally, the circumferential sides of each slip 52 may have angled surfaces 74 which taper inwardly moving in a radially inward direction. In other words, the radial exterior of each slip 52 is wider than the radial interior at each linear/axial position along the slip 52.

The slot 50 which receives the slip 52 has corresponding angled surfaces 76 which similarly cause the slot 50 to be circumferentially narrower at a radially inward position than a radially outward position. The corresponding tapers and angled surfaces 74, 76 are thus able to effectively cooperate and force the tapered slips 52 in a radially outward direction as the actuating cylinder 62 forces the slips 52 to move linearly with respect to cone 44 as cone 44 is held by abutment 46. With this configuration, each slip 52 supports an adjacent slip 52 though the cone 44 itself. In one or more embodiments of the present disclosure, such circumferential loading through the cone 44 prevents radial deflection or collapse into the mandrel 42 while allowing bypass flow under the slips 52. According to one or more embodiments of the present disclosure, each slip 52 may also include a head 78 at its upper end 72, which may be constructed to facilitate retention of slips 52 along cone 44 when liner hanger assembly 30 is run-in-in-hole. For example, the head 78 of each slip 52 may be rotated and inserted into an expanded opening 94 at a top of the corresponding cone slot 50. The head 78, which serves as a retention feature of the slips 52, may be shaped like a hammerhead, for example, in one or more embodiments of the present disclosure.

Figure 3A:
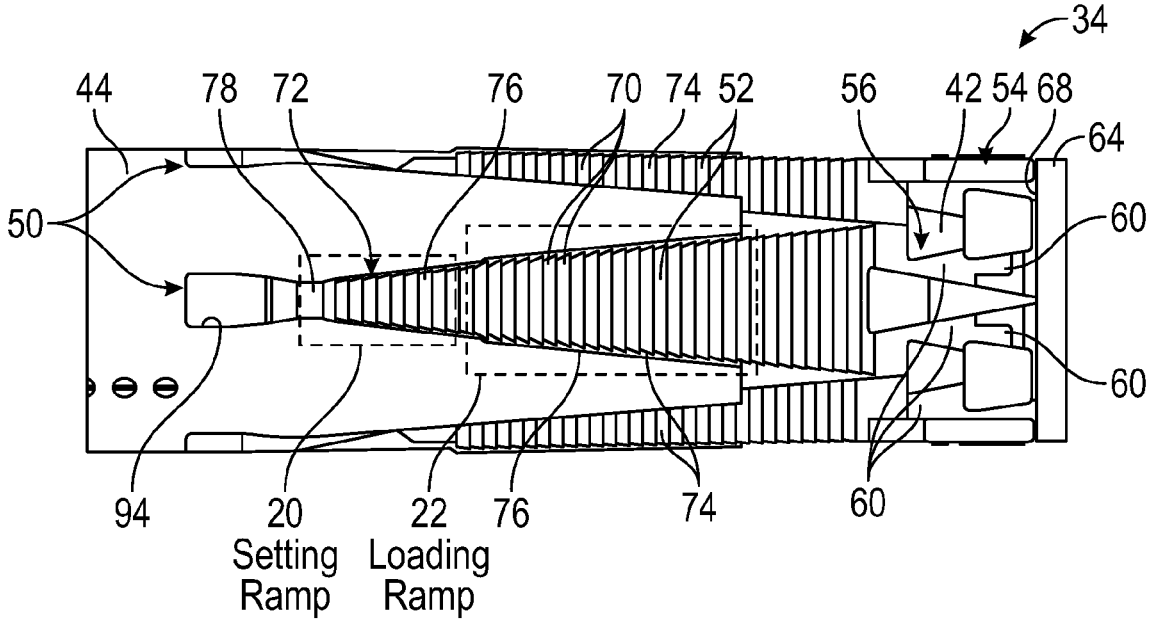
FIGS. 3A and 3B show a portion of the liner hanger having a setting ramp uphole of a loading ramp in run-in-hole and set positions, according to one or more embodiments of the present disclosure.
Figure 3B:
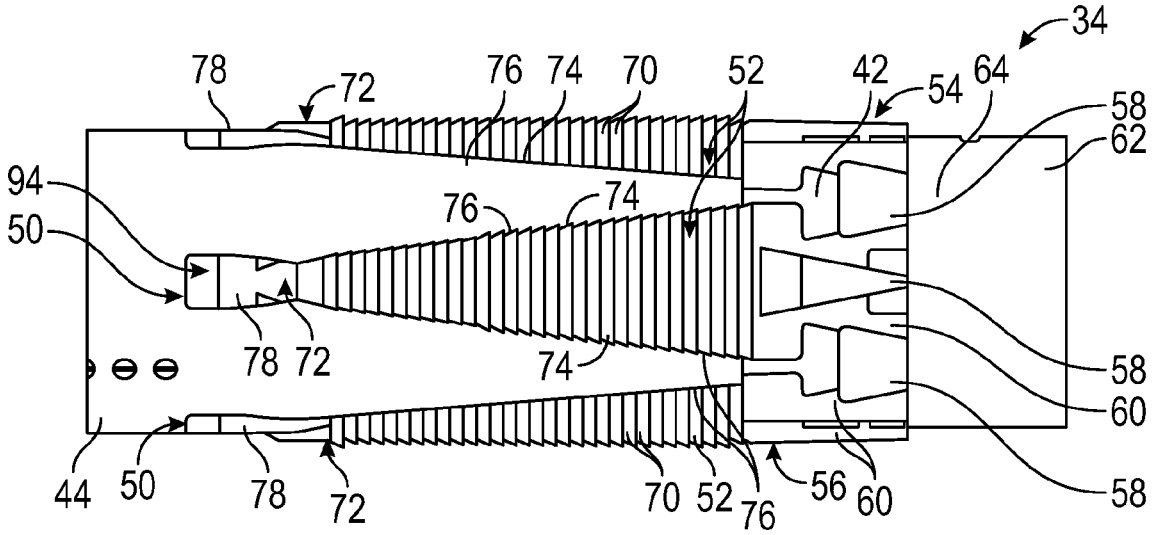
Figure 4:
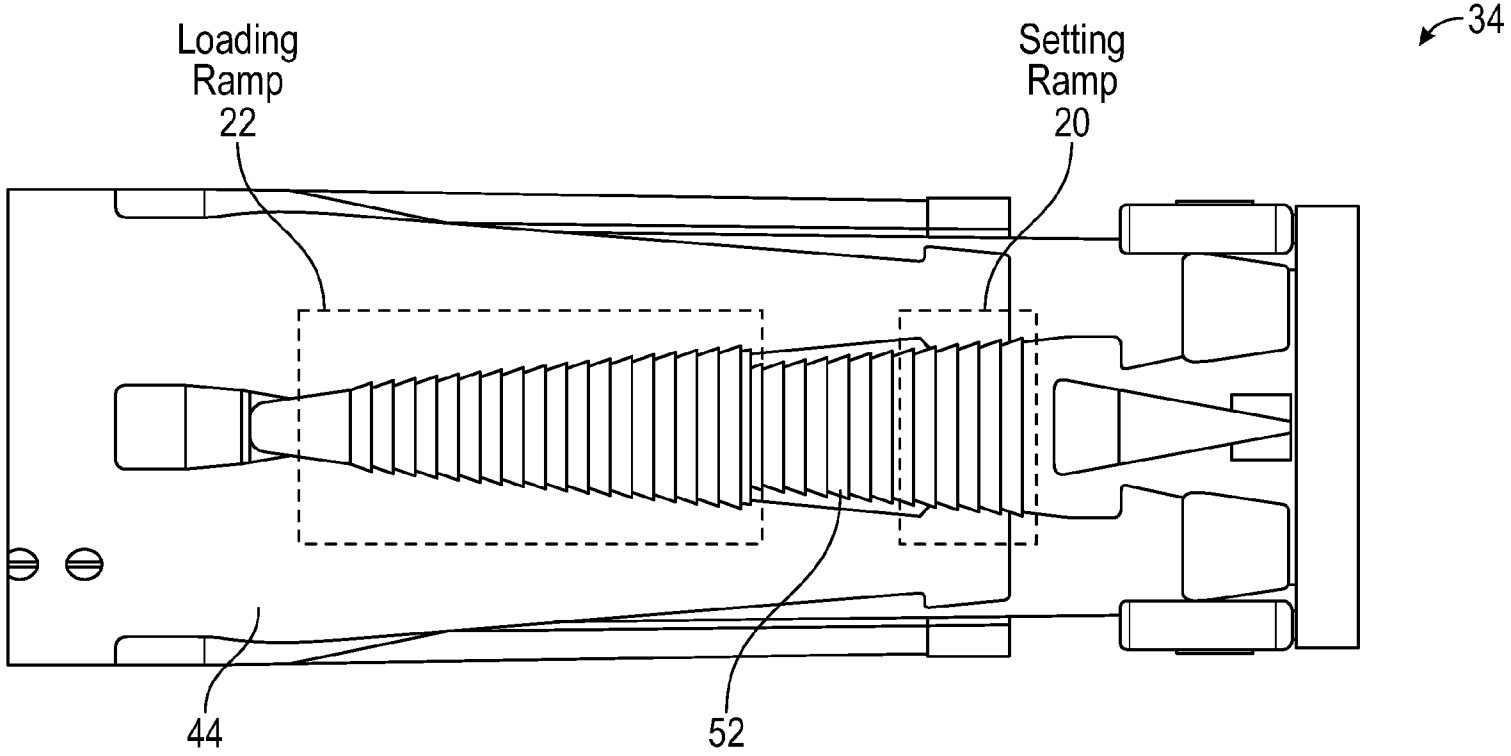
FIG. 4 shows a portion of the liner hanger having a setting ramp downhole of a loading ramp in a set position, according to one or more embodiments of the present disclosure.

Referring now to FIGS. 3A and 3B, a portion of the liner hanger 34 according to one or more embodiments of the present disclosure is shown in run-in-hole and set positions, respectively. As shown in FIG. 3A, each slip 52 and a corresponding cone slot 50 may include a setting ramp 20 and a loading ramp 22 separate from the setting ramp 20, according to one or more embodiments of the present disclosure. That is, the liner hanger 34 according to one or more embodiments of the present disclosure may include a design that separates the cone 44 and slip 52 designs into dedicated zones for setting and loading. As shown in FIGS. 3A and 3B, the setting ramp 20 may be disposed uphole of the loading ramp 22, according to one or more embodiments of the present disclosure. As shown in FIG. 4, however, the setting ramp 20 may be disposed downhole of the loading ramp 22 without departing from the scope of the present disclosure.

Referring back to FIGS. 3A and 3B, in one or more embodiments of the present disclosure, the setting ramp 20 facilitates initial contact between the slip 52 and the cone 44 at low actuation loads. As further described below, this initial contact may be at a single point with offset angles to drive the slip 52 to rise at an angle (biased), which then concentrates the slip-casing contact to fewer teeth 70, therefore resulting in a higher contact pressure and a more effective bite into the host casing 38, according to one or more embodiments of the present disclosure. Moreover, this initial contact enables the setting ramp 20 to distribute a higher radial force into the host casing 38 for a more effective bite by the slips 52 into an interior surface of the host casing 38, according to one or more embodiments of the present disclosure. Further, the loading ramp 22, which accommodates higher hanging loads, distributes lower radial force to prevent deformation outward (i.e., ballooning) of the host casing 38 or collapse into the mandrel 42, according to one or more embodiments of the present disclosure.

Still referring to FIGS. 3A and 3B, a key aspect to the liner hanger 34 design according to one or more embodiments of the present disclosure is that only the setting ramp 20 surfaces between the slip 52 and the cone 44 make contact during the setting of the liner hanger 34. As previously described, initial contact between the slip 52 and the cone 44 establishes a successful set at low actuation loads. That is, according to one or more embodiments of the present disclosure, ramp angles of the slip 52 and the cone 44 are designed to ensure the slip 52 stays stationary axially within the host casing 38, and relative motion is achieved between the slip 52 and the cone 44. This aspect of the design ensures a reliable setting of the slips 52 in a variety of casing conditions.

In view of FIG. 3B, for example, when higher loads are applied to the liner hanger 34, the setting ramp 20 deforms, and the gap between the loading ramp 22 of the slip 52 and cone 44 (FIG. 3A) is closed. Moreover, as higher loads are applied to the liner hanger 34, the head 78 or the retention feature above the setting ramp 20 may begin to deflect outward, which increases the contact area between the slip 52 and the cone 44, thereby enabling higher hang load capacities with lower contact pressure, in one or more embodiments of the present disclosure. According to one or more embodiments of the present disclosure, the effective ramp angle of the loading ramp 22 varies from the effective ramp angle of the setting ramp 20. For example, the effective ramp angle of the loading ramp 22 is greater than an effective ramp angle of the setting ramp 20 according to one or more embodiments of the present disclosure.

Referring now to FIGS. 5A and 5B, an example of a biased slip design of a liner hanger 34 according to one or more embodiments of the present disclosure is shown. As further described below, the biased slip design advantageously ensures a successful initial "set" into the host casing 38. Specifically, FIG. 5A shows a portion of the liner hanger 34 in a run-in-hole position. As shown in FIG. 5A, the cone 44 of the liner hanger 34 includes a cone ramp angle $\theta_c$, and the slip 52 includes a slip ramp angle $\theta_s$.

According to one or more embodiments of the present disclosure, the cone ramp angle $\theta_c$ may be different from the slip ramp angle $\theta_s$. Because of the difference in angles between the ramp on the slip 52 and cone 44, the actuation force is focused to a smaller number of teeth 70 on the slip 52. For example, when the actuation force is applied, the slip 52 is designed to contact the cone ramp 45 at a single point 51 and is unsupported on the other end (FIG. 5A), which causes the slip 52 to tilt and rise toward the host casing 38 until at least one tooth 70 on the initially supported end of the slip 52 contacts the host casing 38 (FIG. 5B). In this way, the initially supported end of the slip 52 that rises first is "biased." For example, if the slip 52 is designed to bite first on the downhole end, the slip 52 is considered to be biased downhole, and if the slip 52 is designed to bite first on the uphole end, the slip 52 is considered to be biased uphole.

As previously described, the slip 52 shown in FIGS. 5A and 5B is biased downhole. Indeed, as shown in FIGS. 5A and 5B, for example, the slip ramp angle θ, is greater than the cone ramp angle $\theta_c$. When the slip ramp angle $\theta_s$ is greater than the cone ramp angle $\theta_c$, the downhole side of the slip 52 will rise first and bite into the host casing 38; that is, the slip 52 is biased downhole. Alternatively, when the cone ramp angle $\theta_c$ is greater than the slip ramp angle $\theta_s$, as shown in FIGS. 6A and 6B, for example, the uphole side of the slip 52 will rise first and bite into the host casing 38; that is, the slip 52 is biased uphole.

Advantageously, as shown in FIGS. 5A-6B, offsetting or "biasing" the ramp angles of the slip and the cone $\theta_s$, $\theta_c$ concentrates the initial bite of the slip 52 to a smaller area of the host casing 38. For example, the area may be so small that only a single tooth 70 of the slip 52 initially bites into the host casing 38. By concentrating the initial bite of the slip 52 to a smaller area of the host casing 38, in accordance with one or more embodiments of the present disclosure, higher contact pressures may be achieved, and the depth of penetration of the bite into the host casing 38 during setting of the slips 52 may be increased, when compared to an "unbiased" slip that rises evenly parallel to the casing ID, for example. At higher loads, additional teeth 70 of the slips 52 may bite into the host casing 38 to distribute the loads over a larger area of the host casing 38 to prevent large deformation of the host casing 38 radially outward (i.e., ballooning). Moreover, by offsetting the ramp angles $\theta_s$, $\theta_c$ between the slip and the cone, the movement and interaction between the components including the host casing 38 can be determined without varying the profiles of the teeth 70 or wickers on the outer surface of the slip 52. Modifying the teeth 70 geometry to a non-uniform design can further control the concentration of force in the host casing 38, according to one or more embodiments of the present disclosure.

Figure 7:
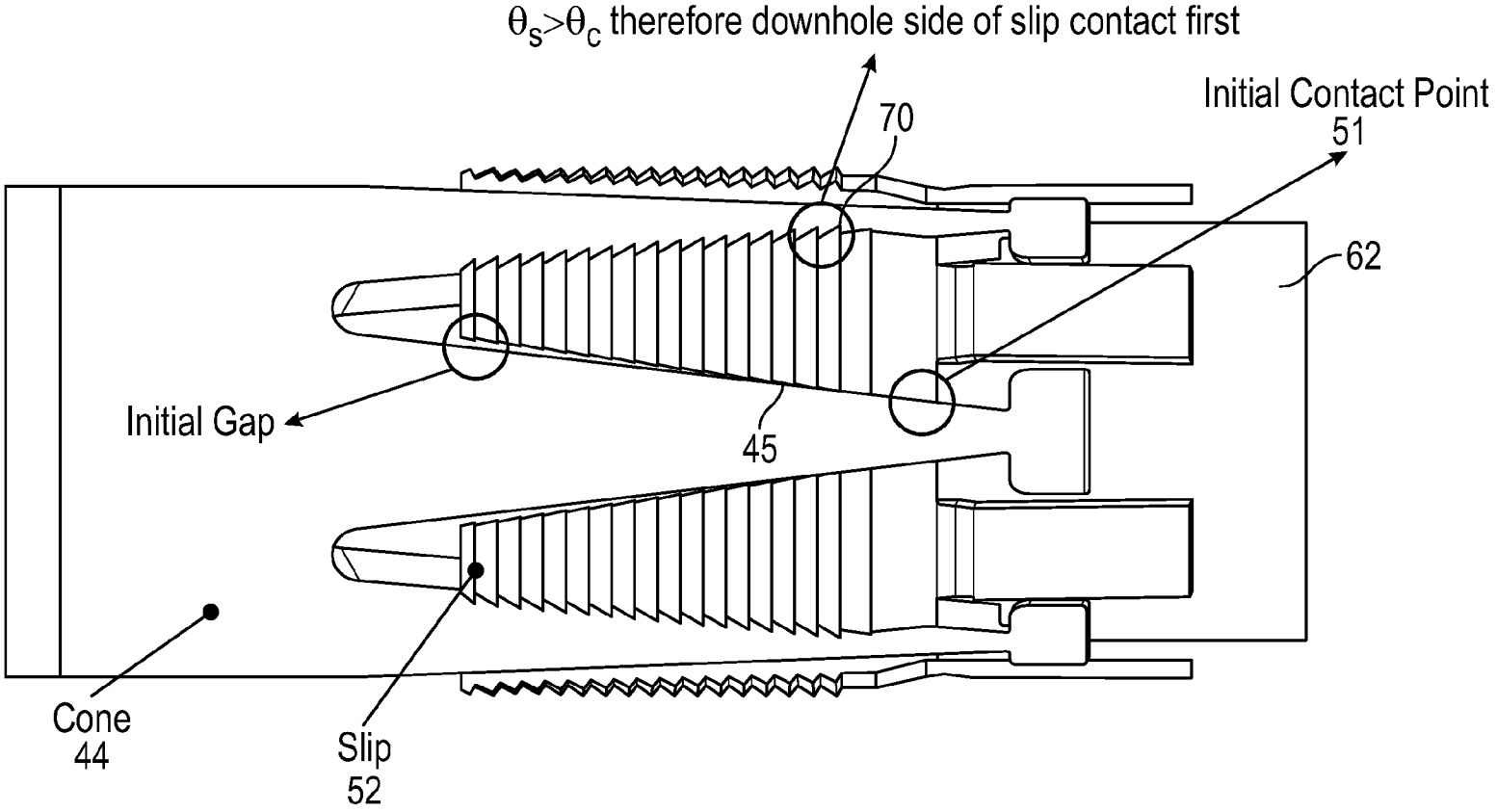
FIG. 7 shows an example of a biased downhole slip of a liner hanger, according to one or more embodiments of the present disclosure.

Referring now to FIG. 7, another example of a biased downhole slip 52 of a liner hanger 34 according to one or more embodiments of the present disclosure is shown. For example, the cylinder 62 may generate an actuation force on the slips 52, causing the slips 52 to contact the cone ramps 45 of the cone 44 at a single initial contact point 51. Because the slips 52 are unsupported at the end opposite the single initial contact point 51, the slips 52 tilt and rise toward the host casing 38 until the teeth 70 on the initially supported end of the slips 52 (here, the downhole end of the slips 52) contact the host casing 38.

Still referring to FIG. 7, the biased slip design of the liner hanger 34 according to one or more embodiments of the present disclosure may utilize an effective ramp angle $\theta_e$ created by the slip ramp angle $\theta_s$ and the cone ramp angle $\theta_c$. For example, with respect to the effective ramp angle $\theta_e$ for the setting portion of the biased slip design, the slip ramp angle $\theta_s$ is essentially the effective ramp angle $\theta_e$ insofar as the slip ramp angle $\theta_s$ dictates the stroke needed to set the slips 52 since the single initial contact point 51 with the cone ramp 45 is fixed (at the lower end of the cone 44 where the radius finishes). After the slips 52 are set and further loading initiates, the effective ramp angle $\theta_e$ of the biased slip design may include a combination of both the cone 44 and the slip 52 due to deformation of both mating surfaces.

It should be noted that the liner hanger 34 according to one or more embodiments of the present disclosure my include one or both of the separate setting ramp 20 and loading ramp 22 design, and the biased angle slip design, as previously described. Further, it should be noted the liner 32, liner hanger 34, and running string 40 may be constructed in various sizes and configurations. Additionally, each of the components of the overall liner hanger 34 may utilize: various engagement features, differing angled surfaces, different numbers of cooperating angled surfaces, different ramp angles, different setting and loading ramps, various actuators, e.g. actuating cylinders, and/or other features to enable the desired operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, the system comprising:
a liner hanger comprising:
a mandrel;
a cone mounted about the mandrel, the cone having tapered slots, wherein each of the tapered slots includes a slot setting ramp and a slot loading ramp;
a plurality of tapered slips, wherein each tapered slip is slidably received in a respective tapered slot, each tapered slip comprising a slip setting ramp, a slip loading ramp, and a plurality of teeth;
and
an actuator mounted about the mandrel to selectively shift the plurality of tapered slips between a setting position and a loading position, wherein:
in the setting position, the slip setting ramp is engaged with the slot setting ramp, and the slip loading ramp is not engaged with the slot loading ramp, and
in the loading position, the slip loading ramp is engaged with the slot loading ramp.

2. The system as recited in claim 1, wherein each tapered slip is wider, in a circumferential direction, at a lower end than at an upper end.

3. The system as recited in claim 1, further comprising:
a retention ring,
wherein each tapered slip comprises a retention end that engages the retention ring, and
wherein the actuator comprises a hydraulically actuated cylinder that overlaps the retention ring.

4. The system as recited in claim 3, wherein the hydraulically actuated cylinder comprises a face that moves against each tapered slip and forces the tapered slip in an axial direction during setting of the plurality of tapered slips.

5. The system as recited in claim 1, wherein, in the setting position, at least one tooth of the plurality of teeth is configured to be forced into gripping engagement with a host casing.

6. The system as recited in claim 1, wherein the slip setting ramp is uphole of the slip loading ramp.

7. The system as recited in claim 1, wherein the slip setting ramp is downhole of the slip loading ramp.

8. The system as recited in claim 1, wherein an effective ramp angle of the slip loading ramp and the slot loading ramp of the respective tapered slot is greater than an effective ramp angle of the slip setting ramp and the slot setting ramp of the respective tapered slot.

9. The system as recited in claim 1, wherein:
the cone comprises a cone ramp angle;
each tapered slip comprises a slip ramp angle; and
the cone ramp angle is different from the slip ramp angle.

10. The system as recited in claim 9, wherein, upon an actuation force by the actuator:
each tapered slip is configured to contact the respective tapered slot in which the tapered slip is slidably received at a single point at a first end of the tapered slip; and
a second end of each tapered slip is unsupported, causing the first end of the tapered slip to rise toward and bite into a host casing.

11. A method comprising:
running the liner hanger of claim 1 into a downhole location in a wellbore;
actuating the plurality of tapered slips to shift the plurality of tapered slips into the setting position to bite into a host casing at the downhole location in the wellbore.

12. The method of claim 11, wherein:
the cone comprises a cone ramp angle;
each tapered slip comprises a slip ramp angle; and
the cone ramp angle is different from the slip ramp angle.

13. The method of claim 11, further comprising:
keeping the plurality of tapered slips stationary axially within the host casing.

14. A system for use in a well, the system comprising:
a liner hanger comprising:
a mandrel;
a cone mounted about the mandrel, the cone having tapered slots and a cone ramp angle, wherein each of the tapered slots includes a slot setting ramp and a slot loading ramp;
a plurality of tapered slips, wherein each tapered slip is slidably received in a respective tapered slot, each tapered slip comprising a slip setting ramp, a slip loading ramp, a slip ramp angle, and a plurality of teeth, wherein the slip ramp angle is different from the cone ramp angle; and
an actuator mounted about the mandrel to selectively shift the plurality of tapered slips between a setting position and a loading position, wherein:
in the setting position, the slip setting ramp is engaged with the slot setting ramp, and the slip loading ramp is not engaged with the slot loading ramp, and
in the loading position, the slip loading ramp is engaged with the slot loading ramp; and
upon an actuation force by the actuator:
each tapered slip is configured to contact the respective tapered slot in which the tapered slip is slidably received at a single point at a first end of the tapered slip; and
a second end of each tapered slip is unsupported, causing the first end of the tapered slip to rise toward and bite into a host casing.

15. A method comprising:
running the liner hanger of claim 14 into a downhole location in a wellbore;
actuating the plurality of tapered slips to shift the plurality of tapered slips into the setting position to bite into the host casing at the downhole location in the wellbore.

* * * * *